United States Patent [19]

Nakamura

[11] Patent Number: 4,867,495

[45] Date of Patent: Sep. 19, 1989

[54] DOOR LOCKING DEVICE FOR A VEHICLE

[75] Inventor: Hitoshi Nakamura, Yokohama, Japan

[73] Assignee: Ohi Seisakusho Co., Ltd., Kanagawa, Japan

[21] Appl. No.: 169,296

[22] Filed: Mar. 17, 1988

[30] Foreign Application Priority Data

Jul. 17, 1987 [JP] Japan ..... 62-177221

[51] Int. Cl.[4] ..... E05C 3/26

[52] U.S. Cl. ..... 292/336.3; 292/DIG. 62

[58] Field of Search ..... 292/216, 336.3, 280, 292/DIG. 62, 346, DIG. 14; 70/416, 418

[56] References Cited

U.S. PATENT DOCUMENTS

| | | | |
|---|---|---|---|
| 2,795,947 | 6/1957 | Peras | 292/216 X |
| 3,287,049 | 11/1966 | Shay | 292/216 X |
| 3,740,980 | 6/1973 | Schimizzi et al. | 292/DIG. 43 X |
| 3,848,910 | 11/1974 | Wilfert et al. | 292/216 |
| 4,155,233 | 5/1979 | Lira | 292/92 |

FOREIGN PATENT DOCUMENTS

| | | |
|---|---|---|
| 0072432 | 3/1986 | European Pat. Off. . |
| 61-130365 | 3/1988 | Japan . |

*Primary Examiner*—Richard E. Moore

*Attorney, Agent, or Firm*—Helfgott & Karas

[57] ABSTRACT

A door locking device for a vehicle comprising crank shaft means disposed in a door lock-unlocking mechanism for locking and unlocking the door, and having a crank arm portion; and holding means having a recessed portion for receiving the crank arm portion of the crank shaft means, said crank arm portion being associated in operation with the holding means with a play within the recessed portion such that the crank arm portion is rotated in at least a range required to lock and unlock the door when the holding means is restricted in a neutral position. The crank arm portion is rotated between locking and unlocking positions by engaging the crank arm portion with the recessed portion of the holder.

3 Claims, 5 Drawing Sheets

DOOR LOCKING DEVICE FOR A VEHICLE

The present invention relates to a door locking device for a vehicle having a structure for preventing the vehicle and the luggage therein from being stolen.

BACKGROUND OF THE INVENTION

In general, a door locking device for a vehicle is provided with a lock-unlocking lever rotated, towards locking and unlocking positions in a lock-unlocking mechanism. The lock-unlocking lever is normally connected through a rod to a knob for locking and unlocking the lever and a key-cylindrical device, and the connecting ends thereof project from a door locking body outwards.

Therefore, a wire, etc. are inserted into a clearance of the door, and the lock-unlocking lever is rotated in the unlocking direction, so that the vehicle or the luggage therein may be stolen.

To solve the problems mentioned above, there have been proposed various kinds of door locking devices having a structure for preventing the theft such that the lock-unlocking lever cannot be easily rotated from the outside.

Japanese Laid-Open Utility Mode Application No. 61-130365, the applicant of which is the one of the present application, discloses such a door locking device in which a protector for preventing the theft is provided in a connecting portion between a rod connected to a key-cylindrical device and a lock-unlocking lever so that a wire, etc. are not easily engaged with the lock-unlocking lever. In such a door locking device, the structure of the theft preventing device is complicated and the number of parts is large, and a large number of operations is needed to manufacture and assemble the device, thereby increasing the cost of the door locking device.

SUMMARY OF THE INVENTION

To overcome the problems mentioned above, an object of the present invention is to provide a door locking device in which the structure is simplified and the cost is reduced and the theft is prevented.

With the above object in view, the present invention resides in a door locking device for a vehicle comprising crank shaft means disposed in a door lock-unlocking mechanism for locking and unlocking the door, and having a crank arm portion; and holding means having a recessed portion for receiving the crank arm portion of the crank shaft means, said crank arm portion being associated in operation with the holding means with a play within the recessed portion such that the crank arm portion is rotated in at least a range required to lock and unlock the door when the holding means is restricted in a neutral position. The crank arm portion is rotated between locking and unlocking positions by engaging the crank arm portion with the recessed portion of the holder.

BRIEF DESCRIPTION OF THE DRAWINGS

The present invention will be more apparent from the following preferred embodiment thereof in conjunction with the accompanying drawings in which.

DETAILED DESCRIPTION OF THE PREFERRED EMBODIMENTS

The preferred embodiment of the present invention will now be described with reference to the accompanying drawings.

Figure 1A:
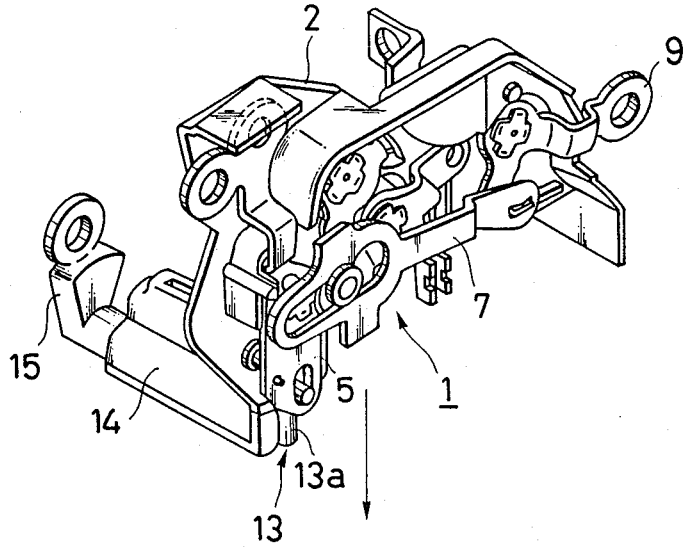
FIGS. 1A and 1B show a door locking device in one embodiment of the present invention, and are respectively a perspective view on a cover side provided with a lock-unlocking mechanism and a perspective view on a door locking body side.
Figure 1B:
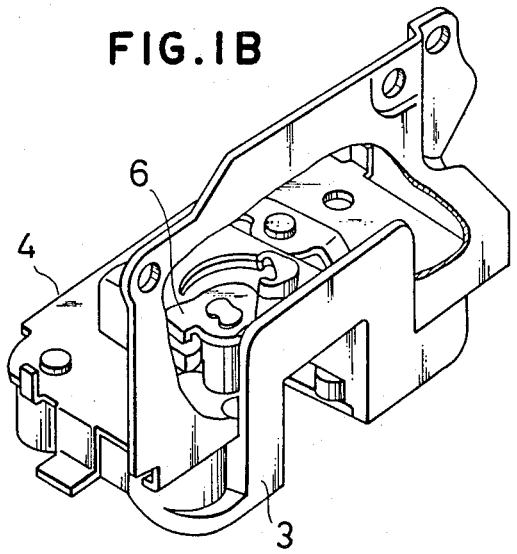

As shown in FIGS. 1A and 1B, in a door locking device, a cover 2 is made of synthetic resin and has an inner surface for assembling a lock-unlocking mechanism 1 thereon in advance, and a base plate 4 is fixed onto the rear surface of a box-shaped door locking body 3 made of synthetic resin with which a well-known latch, a pole, etc., are assembled. A lock-unlocking mechanism 1 is mounted on the outside of the door locking body 3 by joining the cover 2 onto the base plate side, and the cover 2 covers the outside of the lock-unlocking mechanism 1.

Figure 2:
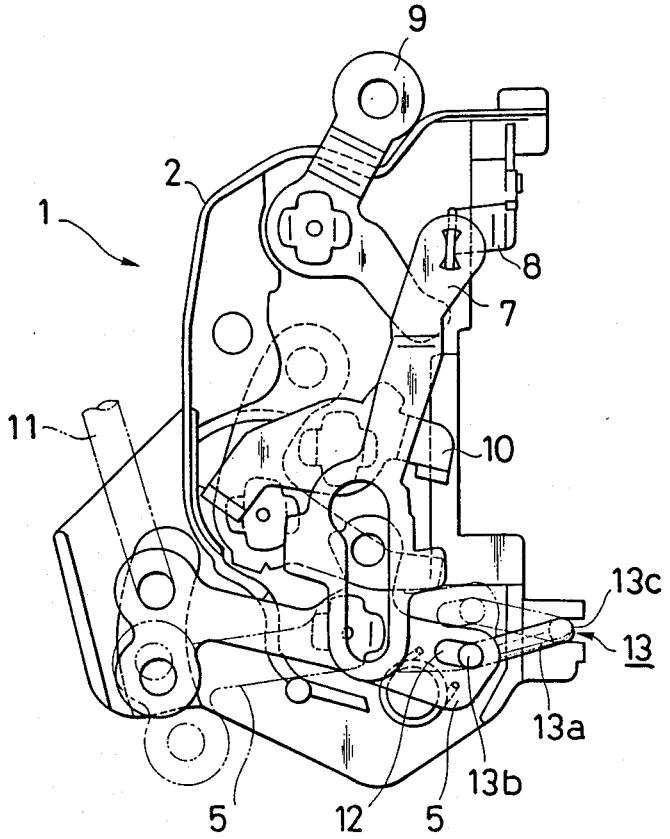
FIG. 2 is a front view on the side of the lock-unlocking mechanism.

As shown in FIG. 2, the lock-unlocking mechanism 1 has, in an intermediate portion thereof, a lock-unlocking lever 5 pivotally mounted on the cover 2 and pivoted between locking and unlocking positions, and a sublever 7 engage with the lock-unlocking lever 5 and moved in association with this lever 5. The sublever 7 is engaged with and disengaged from an open lever 6 pivotally mounted on the door locking body 3 and releasing the engagement between the latch and the pole. The lock-unlocking mechanism 1 further has an outside lever 8 and an inside lever 9 engaged with an upper portion of the sublever 7 to move this upper portion upwards and downwards, and a cancelling lever 10 pivotally mounted approximately on an intermediate portion of the cover 2.

Figure 4:
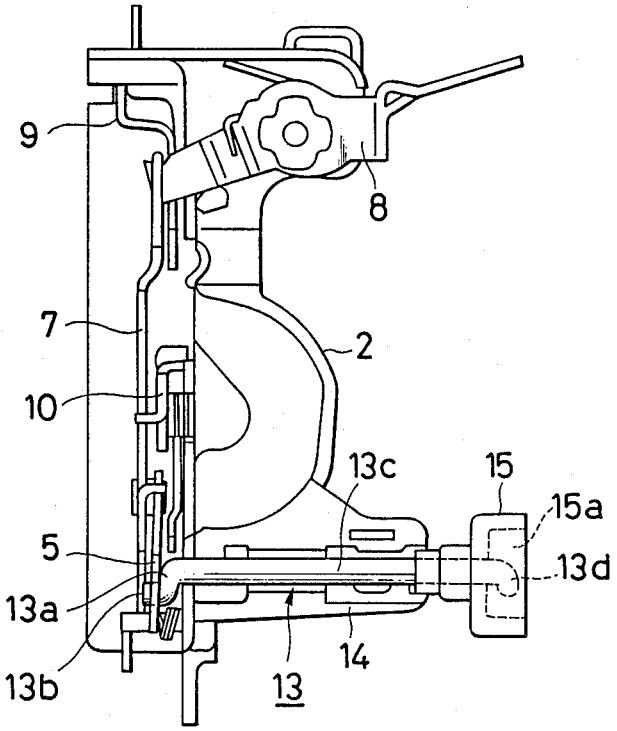
FIG. 4 is a right side view on the side of the lock-unlocking mechanism.

In FIG. 2, a left end portion of the lock-unlocking level 5 is connected to an unillustrated knob lever through a rod 11, and a right end portion of the lock-unlocking lever 5 has an elongated hole 12 therein. The elongated hole 12 receives a short shaft portion **13*b* connected to an end of a first crank arm 13*a* in a crank shaft 13 formed by bending an elongated round bar in the shape of a crank. As shown in FIG. 4, a shaft portion 13*c* of the crankshaft 13 is supported by a bearing portion 14 integrally formed with the cover 2 and projecting backwards. A second crank arm 13*d* of the crank shaft 13 is disposed at the rear end of the bearing portion 14 and is perpendicularly bent in the same direction as that of the first crank arm 13*a*. The second crank arm 13*d* projects backwards from the bearing portion 14** by a predetermined length.

Figure 3:
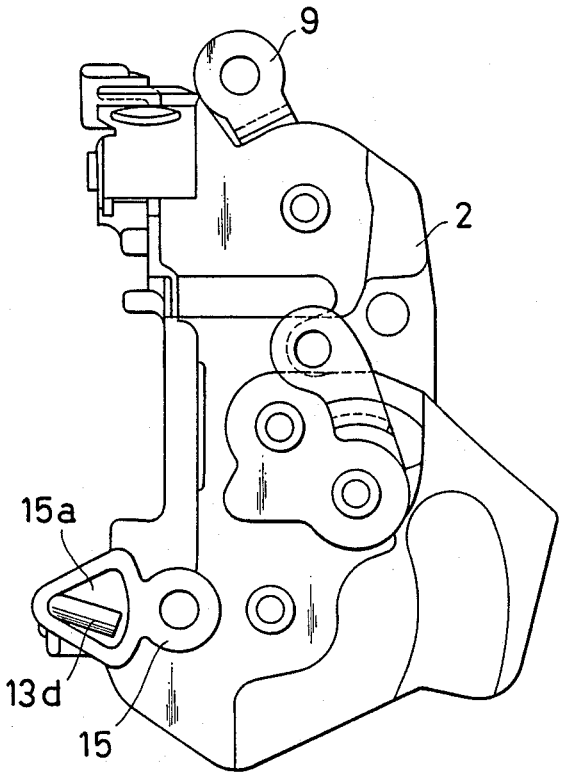
FIG. 3 is a rear view on the side of the lock-unlocking mechanism.

As shown in FIGS. 3 and 4, the second crank arm **13*d* is located within a fan-shaped recessed portion 15*a* of a holder 15 rotatably fitted onto the rear end side of the crank shaft 13, and is engaged with the recessed portion 15*a***.

The holder 15 is connected to the crank shaft 13 and a key-cylindrical device 16 disposed in a door which is not shown, through a rod 17.

Figure 5:
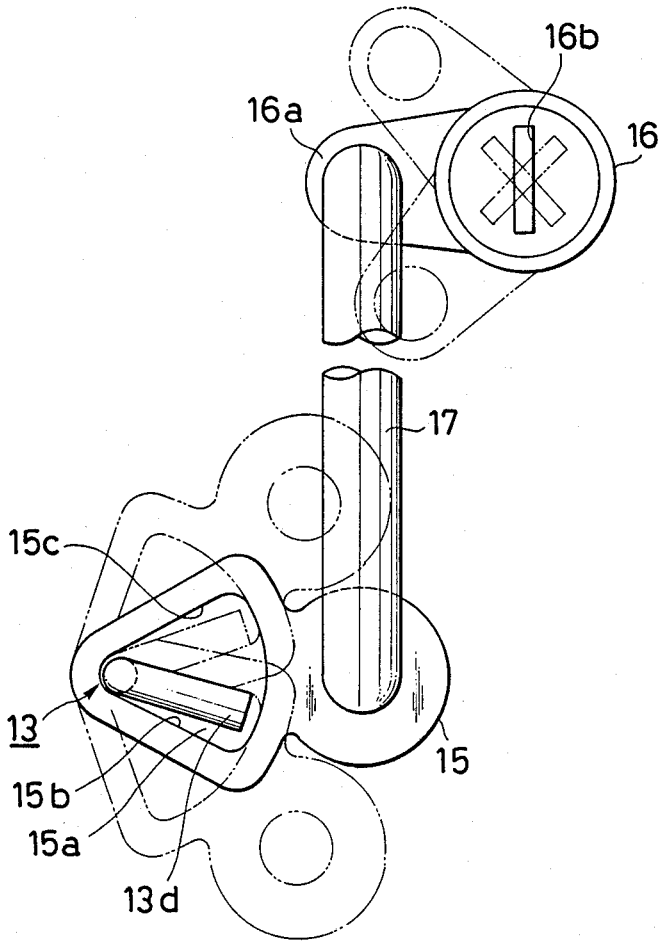
FIG. 5 is a view for explaining the mutual relation and operation between a crankshaft, a holder and a key-cylindrical device.

The mutual relation and operation of the second crank arm 13*d*, the holder 15 and the key-cylindrical device 16 will be next described in detail with reference to FIG. 5.

The holder 15 is connected through the rod 17 to an end of a key plate 16*a* integrally rotated with an unillustrated rotor in the key-cylindrical device 16. As shown by solid line of FIG. 5, when the key plate 16*a* is located in an approximately horizontally neutral position, the holder 15 is restricted in the approximately horizontally neutral position. When the key plate 16*a* is rotated to an upward locking position and a downward unlocking position shown by double dotted chain line of FIG. 5 by rotating an unillustrated key inserted into a key groove 16*b* of the key-cylindrical device 16, the holder 15 is moved toward the upward locking position and the downward unlocking position in association with the movement of the key plate 16*a*.

It is preferable that the key can be inserted into and pulled out of the key groove 16*b* only when the key plate is in the neutral position, and the key plate 16*a* is restricted in the neutral position when the key is pulled out of the key groove 16*b*.

When the holder 15 is in the neutral position, the fan-shaped recessed portion 15*a* has a play having the same circumferential size equal to or greater than the one of the second crank arm 13*d* pivoted around an arc between the locking and unlocking positions.

Accordingly, when the lock-unlocking lever 5 is rotated to the unlocking position as shown by solid line of FIG. 2, the second crank arm 13*d* within the fan-shaped recessed portion 15*a* contacts a lower edge portion 15*b* of the recessed portion 15*a*, or is pivoted in proximity to the lower edge portion 15*a*. When the lock-unlocking lever 5 is rotated to the locking position as shown by double dotted chain line of FIG. 2, the second crank arm 13*d* contacts an upper edge portion 15*c* of the recessed portion 15*a* as shown by double dotted chain line of FIG. 2, or is pivoted in proximity to the upper edge portion 15*c*.

When the key plate 16*a* in the key-cylindrical device 16 is rotated from the horizontally neutral position in the clockwise direction as shown by double dotted chain line, the holder 15 is rotated through the rod 17 in the counterclockwise direction so that the lower edge portion 15*b* of the recessed portion 15*a* contacts the second crank arm 13*d*, thereby pivoting it from the unlocking position to the upper locking position and making the lock-unlocking lever 5 in the locking state.

When the key plate 16*a* in the key-cylindrical device 16 is rotated in the counterclockwise direction, the holder 15 is rotated in the clockwise direction, and the second crank arm 13*d* contacts the upper edge portion 15*c* of the recessed portion 15*a*, thereby pivoting the second crank arm 13*d* downwards and making the lock-unlocking lever 5 in the unlocking state.

The present invention is not limited to the embodiment mentioned above, but may be changed in various modifications within the scope of the invention.

For example, in the embodiment mentioned above, the first crank arm 13*a* of the crank shaft 13 is engaged with the lock-unlocking lever 5, but may be engaged with the sublever 7 or another member rotated at the lock and unlocking times.

Further, a cover may be disposed to cover the fan-shaped recessed portion 15*a* of the holder so as to close the opening thereof, thereby reliably preventing the theft.

As mentioned above, in accordance with a door locking device of the present invention, a crank arm of a crank shaft in a lock-unlocking mechanism operated in association with a key-cylinder is actuated in association with the movement of a holder, thereby preventing the crank arm from being operated from the outside and preventing the theft.

Further, the door locking device is simplified in structure and is cheaply manufactured since the key-cylindrical device and the crank shaft are associated in operation with each other through the holder.

The crank arm of the crank shaft has a play in operation within the holder associated with the key-cylindrical device so that the operation of the knob is easily performed.

What is claimed is:

1. A door locking device for a vehicle, comprising a door lock-unlocking mechanism for locking and unlocking a door;

crank shaft means connected to said door locking-unlocking mechanism;

a key-cylindrical device disposed in the door and including plate means actuated by a key to rotate from a neutral position in two opposite directions; and holding means connected to said plate means to rotate from a neutral position in two opposite directions integrally with said plate means, said crank shaft means including a crank arm portion, said holding means including a recessed portion, said crank arm portion of said crank shaft means being engaged in said recessed portion and being rotatable upon rotation of said holding means, to rotate said crank shaft means to actuate said lock-unlocking mechanism, said crank arm portion being associated in operation with said holding means with a play within said recessed portion such that said crank arm portion is rotated in at least a range required to lock and unlock the door when said holding means is restricted in the neutral position by said key-cylindrical device.

2. A door locking device as claimed in claim 1, wherein said holding means comprises a holder connected to said plate means by a rod.

3. A door locking device as claimed in claim 2, wherein said crank arm portion is rotated between locking and unlocking positions by engaging the crank arm portion in a recessed portion of the holder.

* * * * *